United States Patent [19]

Shimizu

[11] 4,215,866

[45] Aug. 5, 1980

[54] LINE CONNECTING TABLE GAME SET

[75] Inventor: Takeshi Shimizu, Yashioshi, Japan

[73] Assignee: Kabushikikaisha Anoa, Tokyo, Japan

[21] Appl. No.: 969,327

[22] Filed: Dec. 14, 1978

[30] Foreign Application Priority Data

Feb. 24, 1978 [JP] Japan ..... 52-22290[U]

[51] Int. Cl.[2] ..... A63F 3/02

[52] U.S. Cl. ..... 273/275; 273/287; 273/288

[58] Field of Search ..... 273/275, 284, 287, 288

[56] References Cited

U.S. PATENT DOCUMENTS

| | | | |
|---|---|---|---|
| 471,666 | 3/1892 | Doty | 273/275 |
| 2,162,876 | 6/1939 | Barton | 273/275 X |
| 3,309,092 | 3/1967 | Hardesty et al. | 273/275 X |
| 3,643,956 | 2/1972 | Bovasso | 273/275 |

OTHER PUBLICATIONS

"Scarne's Encyclopedia of Games," by John Searne, published by Harper and Row, New York, Copyright 1973, pp. 551–553.

*Primary Examiner*—Anton O. Oechsle

*Attorney, Agent, or Firm*—Hill, Van Santen, Steadman, Chiara & Simpson

[57] ABSTRACT

A table game set has two player's boards with vertical and horizontal lines thereon to form squares and playing pieces of types having a straight line, a T-shaped line, an L-shaped line or crossed lines drawn on different pieces. Two players sit face-to-face with the set between them and compete to form lines from the start line to the goal line on their respective boards to earn points by arranging pieces in turn. The boards are separated by a surface integral with the boards on which the playing pieces yet to be used may be placed to be selected by the players. A plurality of adjacent bars are slideably held beneath the surface between the boards, with the ends of the bars extending outwardly to designate an award of points when a line from a starting line to a goal line is completed.

8 Claims, 11 Drawing Figures

LINE CONNECTING TABLE GAME SET

BACKGROUND OF THE INVENTION

1. Field of the Invention

This invention relates to table games in which two players sit face-to-face and arrange pieces on a playing board between them.

2. Description of the Prior Art

A number of table games such as Chinese checkers have as a goal the completion of a continuous path from one portion of the playing board to another. The use of a playing board comprised of adjacent squares of alternating colors is also well known, and is employed in games such as checkers and chess.

No game, however, has a separate playing board for each player on which opponents place playing pieces having different line configurations drawn thereon in an effort to complete a continuous line path from a start line to a goal line.

SUMMARY OF THE INVENTION

Two players place the invention between them such that a player's board with vertical and horizontal lines to form rows of squares drawn on the board is in front of each player. Each board has a row closest to the player called a start line and a row farthest from a player called a goal line. The two players' boards are connected by a center surface. A cavity extends beneath the surface in which point bars whose width is approximately that of the rows are parallelly arranged for free sliding in the direction of the playing boards. Both ends of each point bar are exposed. The length of the point bars is such that when one end with a color or a number thereon to indicate points associated therewith is pulled, the other end, also having a color or a number to indicate points is hidden under the surface. The playing pieces consist of L line pieces, straight line pieces, T line pieces and cross line pieces. All pieces used by a player are of the same color. In addition, as trouble pieces, there are two L line pieces and two straight line pieces of different color, and as lucky pieces, two cross line pieces with a circle drawn on the cross point.

Various rules are developed governing play as opponents attempt to gain points by completing continuous line paths from the start line to the goal line by placing the playing pieces on the squares of their respective playing boards.

DESCRIPTION OF THE PREFERRED EMBODIMENTS

Figure 1:
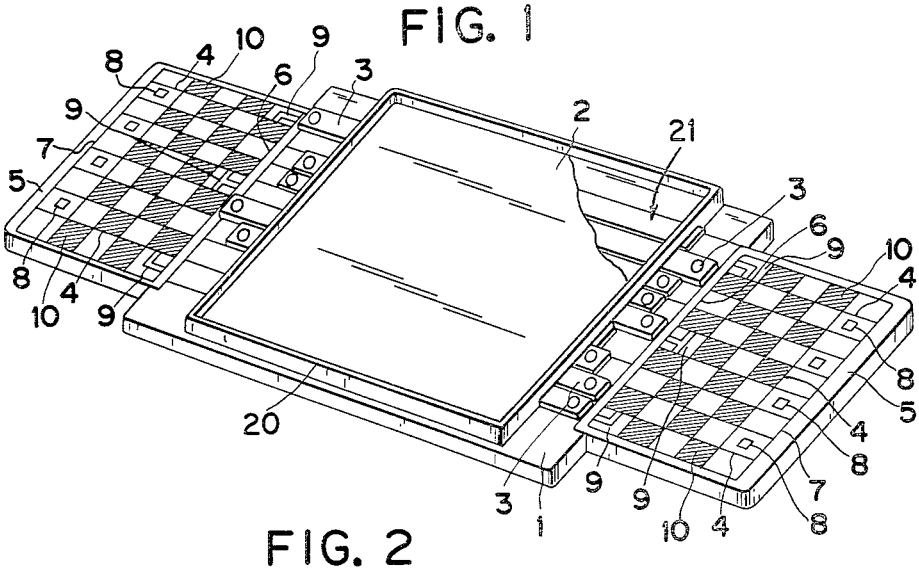
FIG. 1 is a perspective view partially broken away of the line connecting table game set.

In accordance with the principles of the present invention, a center board 1 has a top surface 2, surrounded by a frame 20. A plurality of point bars 3 are placed parallel to each other in a cavity 21 extending through the center board 1. Both ends of the point bars 3 are exposed on the center board 1. The bars 3 slide freely through the cavity 21 in the center board 1.

A player's board 5 is disposed on each of two opposite sides of the center board 1, so that the bars 3 slide between the playing boards 5. Each board 5 has rows of squares formed by a plurality of lines 4. A row of squares on each playing board 5 closest the center board 1 is a goal line 6 and a row of squares closest to each player is a start line 7. In some of the squares on the starting line 7, a starting mark 8 is indicated. A number of squares in the goal line 6 are marked with some designated mark 9 such as a T-shaped line or an L-shaped line. In addition, some squares 10 are of a different color than the remainder of the squares.

It will be understood that the number of rows and squares on each playing board, as well as the number of start marks 8 or piece-designating marks 9 may be varied, and need not necessarily be limited to the exact configuration shown in FIG. 1. It is also not necessary that squares of different colors alternate, a random or any other pattern may also be employed.

Figure 2:
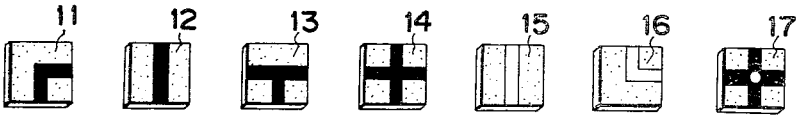
FIG. 2 is a perspective view of the playing pieces to be used in conjunction with the apparatus of FIG. 1.
Figure 3:
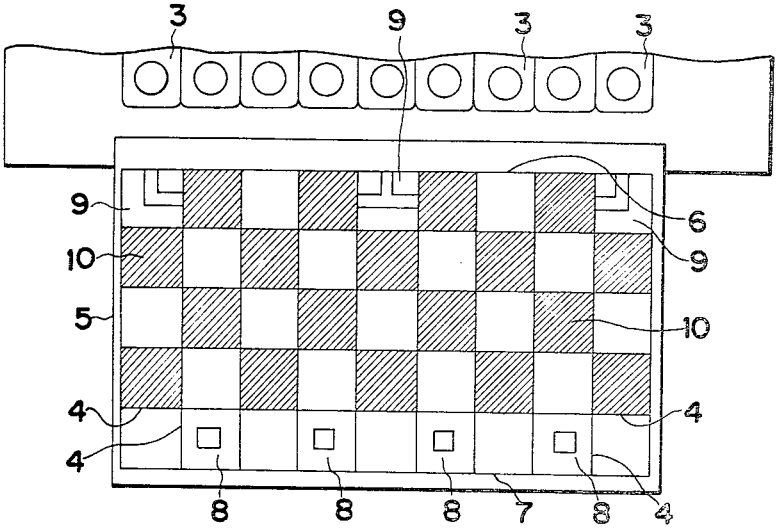
FIG. 3 is an enlarged elevational view of the surface of a playing board shown in FIG. 1.

The various types of playing pieces are shown in FIG. 2. A playing piece 11 has an L-shaped line drawn on one of its large faces. A playing piece 12 has a straight line drawn on one of its large faces. A playing piece 13 has a T-shaped line drawn on one of its large faces, and a playing piece 14 has crossed lines drawn on one of its large faces. A lucky piece 17 is identical to the playing piece 14, however the lucky piece 17 has a circle disposed on the cross point of the crossing lines. The playing pieces 11, 12, 13, 14, and 17 used by one player all have the same color lines drawn thereon. A trouble piece 15 with a straight line drawn on one large face thereof and another trouble piece 16 with an L-shaped line drawn on one large face thereof are designated by the fact that the lines thereon are of a different color than the lines on pieces 11, 12, 13, 14, and 17.

The number of pieces in a complete set is determined by the total number of squares on the player's boards. The table game shown in FIG. 1 has a total of 90 squares on both of the player's boards, but need not be so limited. A suggested composition of a playing piece set is: forty pieces 11, twenty pieces 12, twenty pieces 13, four pieces 14, two pieces 15, two pieces 16, and two pieces 17. The face of each of the pieces 11 through 17 opposite the face having the mark thereon is plain so that the pieces are indistinguishable when placed face down. All of the playing pieces are equivalent in size to the squares on the playing boards 5.

Figure 4A:
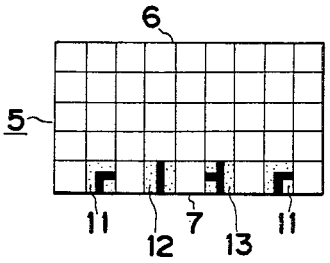
FIG. 4A is an enlarged elevational view of the playing board of FIG. 1 showing an arrangement of playing pieces.
Figure 4B:
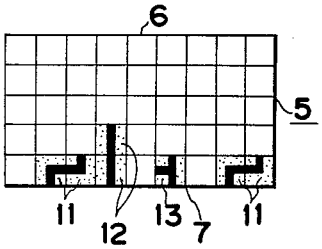
FIG. 4B is a similar enlargement showing the manner in which other pieces may be attached thereto.

The above apparatus may be used as follows. Opponents sit face-to-face with a player's board 5 in front of each player. The pieces 11 through 17 are mixed and placed face down on the surface 2. The playing order is determined in any suitable manner. Players take a piece in turn and must place it in one of the squares with a starting mark 8. If there are four such squares, as shown in FIG. 1, the first four pieces drawn must be placed one to a square. Players then alternate drawing pieces and place them on the playing board 5 in an effort to complete continuous line paths from the start line 7 to the goal line 6. Lines may be drawn in any direction as long as they are continuous, as shown in FIG. 4.

Figure 6:
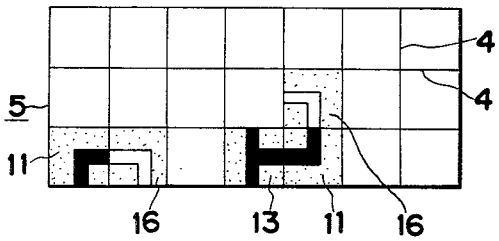
FIG. 6 is an enlarged elevational view of the playing board of FIG. 1 showing the manner in which a trouble piece may be employed.

A trouble piece 15 or 16 may be used to interfere with the play of an opponent on the opponent's board 5. As shown in FIG. 6, a trouble piece 15 or 16 may be placed to connect the mark of a piece already on the player's board. Trouble pieces 15 and 16 are especially useful when placed to direct an opponent's lines back toward the starting line 7. The trouble piece 15 or 16 must be placed in such a manner so that a line on the trouble piece 15 or 16 is connected to a line on one of the pieces 11, 12, 13, 14, or 17 on the opponent's board. A player who has had a trouble piece 15 or 16 placed on his or her playing board 5 must cover the trouble piece 15 or 16 with a piece matching the configuration and direction of the line on the trouble piece 15 or 16. Once placed, a trouble piece 15 or 16 cannot be used again. If a trouble piece 15 or 16 is drawn before the first four pieces have been drawn, it must be placed in one of the squares with a starting mark 8 on the opponent's board.

Figure 5A:
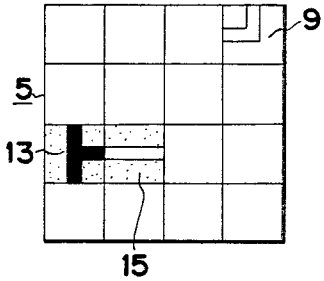
FIG. 5A is an enlarged elevational view of the playing board of FIG. 1 showing an arrangement of pieces.
Figure 5B:
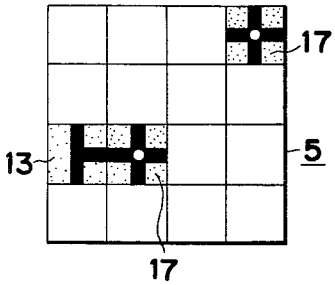
FIG. 5B is a similar view showing the manner in which a lucky piece may be employed.

A lucky piece 17 may be placed in any of the squares on a player's own board, including the squares with some designated mark 9 as shown in FIG. 5. A lucky piece 17 may also replace any of the trouble pieces 15 or 16 placed on a player's board by the opponent.

In the squares 9 having some designated mark, a piece with the same mark must be placed. For example, if a square has an L-shaped line on it, a piece 11 with an L-shaped mark thereon must be played in that square, aligned in the same direction as the mark on the square.

When any piece drawn cannot be placed to make a continuous line, the piece is placed face up on the surface 2 and the player who drew the piece does not play in that turn. If the opponent wants to use the piece, it may be taken in a subsequent turn.

Figure 7:
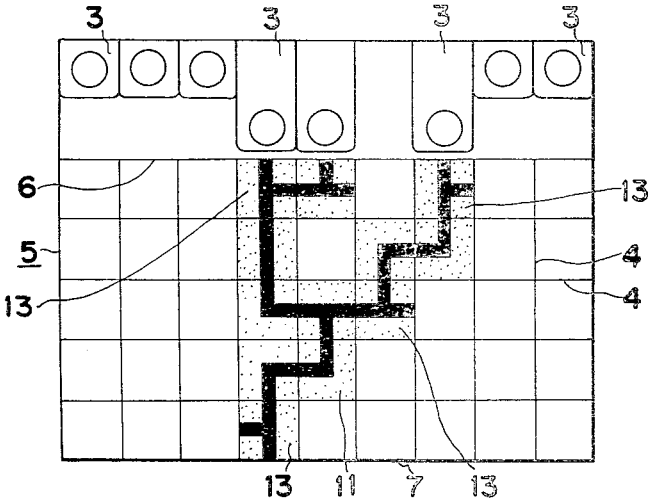
FIG. 7 is an elevational view of the playing board of FIG. 1 showing completed line paths.
Figure 8:
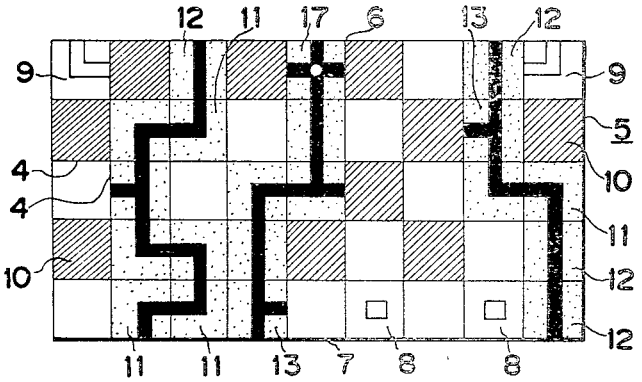
FIG. 8 is an elevational view of the playing board of FIG. 1 showing the status of a player's board after removing pieces not on any of the lines connecting the start and goal lines.

The point bars 3 near the goal line 6 on the player's board 5 are each marked with a color to indicate a point value. For instance, red may indicate ten points and yellow five points. A player pulls the point bar 3 in alignment with a square in the goal line 6 when he or she connects a line to that square as shown in FIG. 7. The other end of the bar 3 is consequently pulled beneath and hidden under the surface 2, and the opponent cannot pull it back even if he or she should subsequently connect a line to that square in the goal line 6.

Figure 9:
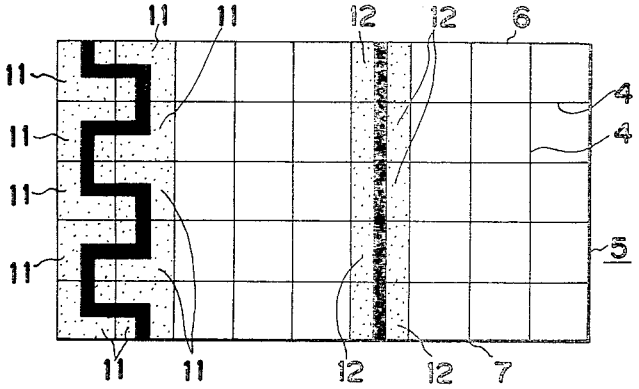
FIG. 9 is an elevational view of the playing board of FIG. 1 showing line paths formed only with pieces of identical type.

The game ends when all of the point bars 3 have been pulled, or when neither of the players can form lines using the pieces 11, 12, 13, 14, and 17 to the goal line 6 anymore. When the game has ended, both players remove all pieces from the playing board 5 not forming a portion of any of the lines either connecting the start line 7 and goal line 6 or forming a line completely contained in the start row 7 with no unattached portions leading to other rows. If there are any squares of some different color, for example black, exposed after removing the pieces 11 through 17 not in any of such lines, points are deducted. For example, if there are two to four such squares, five points may be deducted. If five to ten such squares show, ten points may be deducted. Twenty points may be deducted if there are more than eleven such squares showing. In addition, five points may be deducted if there are trouble pieces 15 or 16 among the pieces removed. The total points earned is tabulated by adding the points on the bars pulled and deducting points attributable to the exposed squares of some different color and points attributable to the trouble pieces 15 and 16 among the pieces removed. If there is any perfect line which is made by connecting either only L-line pieces 11 or straight line pieces 12 as shown in FIG. 9, ten points may be added. It will be understood that such point values are arbitrary and may be varied if desired.

Although other modifications might be suggested by those versed in the art, it should be understood that applicant wishes to embody within the scope of the patent warranted hereon all such modifications as reasonably and properly come within the scope of applicant's contribution to the art.

I claim as my invention:

1. A table game set comprising two four sided playing boards having a plurality of adjacent rows of squares thereon, each said playing board having a goal line and start line disposed on opposite sides thereof;

a plurality of flat, square playing pieces each having a face and having a size equal to one of said squares on the playing board, said playing pieces having a plurality of different line configurations on the face thereof, whereby the playing pieces may be selectively placed in the squares on the playing board to form a continuous line path from a square adjacent the start line to a square adjacent the goal line; and a means mounted on said table game set between said playing boards and aligned with each square adjacent said goal line, said means movable in a direction toward each goal line for respectively designating the first completion of a path to each square adjacent the goal line of each playing board.

2. The table game set of claim 1 wherein a plurality of squares in a row adjacent said start line are designated with start marks.

3. The table game set of claim 1 wherein a plurality of squares in a row adjacent said goal line are designated with different line configurations corresponding to different line configurations on said playing pieces.

4. The table game set of claim 1 wherein the sides of the playing pieces each have a midpoint; and the line configurations on the playing pieces are:

an L-shaped line of a first color connecting the midpoints of any two adjacent sides of the playing piece, an L-shaped line of a second color connecting the midpoints of any two adjacent sides of the playing piece, a straight line of a first color connecting the midpoints of any opposite sides of a playing piece, a straight line of a second color connecting the midpoints of any opposite sides of a playing piece, a T-shaped line having a crossbar which connects the midpoint of any opposite sides of a playing piece and a line extending perpendicularly from a midpoint of the crossbar to a midpoint of a side of a playing piece, a cross having two crossbars each connecting the midpoints of opposite sides of a playing piece, a cross having two crossbars each connecting the midpoints of opposite sides of a playing piece, said cross having a circular dot disposed thereon.

5. A table game set comprising a flat center board having four sides joined at right angles and having a rectangular cavity horizontally extending through two opposite sides thereof;

a plurality of bars disposed parallelly inside said cavity such that each of said bars may freely slide through the cavity, said bars having a length such that a portion of each said bar extends out of the cavity at both opposite sides of the center board;

two playing boards attached to the center board at the opposite sides through which the cavity extends, each said playing board having a plurality of adjacent rows of squares thereon, each said row in alignment with a respective one of said bars; and a plurality of flat, square playing pieces having a face and having a size equal to one of said squares on the playing board, said playing pieces having a plurality of different line configurations on the face thereof;

whereby the playing pieces may be selectively placed in the squares on the playing board to form a continuous line path from a square adjacent the start line to a square adjacent the goal line.

6. The table game set of claim 5 wherein a plurality of squares in a row adjacent said start line are designated with start marks.

7. The table game set of claim 5 wherein a plurality of squares in a row adjacent said goal line are designated with different line configurations corresponding to different line configurations on said playing pieces.

8. The table game set of claim 5 wherein the sides of the playing pieces each have a midpoint; and the line configurations on the playing pieces are:

an L-shaped line of a first color connecting the midpoints of any two adjacent sides of the playing piece, an L-shaped line of a second color connecting the midpoints of any two adjacent sides of the playing piece, a straight line of a first color connecting the midpoints of any opposite sides of a playing piece, a straight line of a second color connecting the midpoints of any opposite side of a playing piece, a T-shaped line having a crossbar which connects the midpoint of any opposite sides of a playing piece and a line extending perpendicularly from a midpoint of the crossbar to a midpoint of a side of a playing piece, a cross having two crossbars each connecting the midpoints of opposite sides of a playing piece, a cross having two crossbars each connecting the midpoints of opposite sides of a playing piece, said cross having a circular dot disposed thereon.

* * * * *